United States Patent [19]

Morman et al.

[11] Patent Number: 4,741,949

[45] **Date of Patent: * May 3, 1988**

[54] ELASTIC POLYETHERESTER NONWOVEN WEB

[75] Inventors: Michael T. Morman, Alpharetta, Ga.; Tony J. Wisneski, Kimberly, Wis.

[73] Assignee: Kimberly-Clark Corporation, Neenah, Wis.

[ * ] Notice: The portion of the term of this patent subsequent to Nov. 17, 2004 has been disclaimed.

[21] Appl. No.: 919,282

[22] Filed: Oct. 15, 1986

[51] Int. Cl.[4] ..... D03D 3/00

[52] U.S. Cl. ..... 428/224; 428/283; 428/288; 428/297; 428/326; 428/364; 428/373; 428/903; 525/437; 528/301

[58] Field of Search ..... 428/224, 283, 288, 326, 428/364, 373, 903, 297; 525/437; 528/301

[56] References Cited

U.S. PATENT DOCUMENTS

| | | | |
|---|---|---|---|
| 2,623,031 | 12/1952 | Snyder | 260/45.4 |
| 2,903,387 | 9/1959 | Wade | 154/101 |
| 2,951,005 | 8/1960 | Hervey | 154/123 |
| 3,594,266 | 7/1971 | Okazaki | 161/173 |
| 3,642,565 | 2/1972 | Ogata et al. | 161/173 |
| 3,700,545 | 10/1972 | Matsui et al. | 161/175 |
| 3,849,241 | 11/1974 | Butin et al. | 161/169 |
| 4,100,324 | 7/1978 | Anderson et al. | 428/288 |
| 4,118,531 | 10/1978 | Hauser | 428/224 |
| 4,150,674 | 4/1979 | Yung | 428/288 |
| 4,223,101 | 9/1980 | Fine et al. | 528/76 |
| 4,323,534 | 4/1982 | Des Marais | 264/176 |
| 4,375,446 | 3/1983 | Fujii et al. | 264/518 |
| 4,426,417 | 1/1984 | Meitner et al. | 428/195 |
| 4,426,420 | 1/1984 | Likhyani | 428/224 |
| 4,442,062 | 4/1984 | Fujii et al. | 264/518 |
| 4,469,734 | 9/1984 | Minto et al. | 428/134 |

FOREIGN PATENT DOCUMENTS

| | | |
|---|---|---|
| 979103 | 1/1965 | United Kingdom . |
| 1575830 | 10/1980 | United Kingdom . |

OTHER PUBLICATIONS

DuPont Technical Bulletin HYT-152.
DuPont Technical Bulletin HYT-164.
DuPont Technical Bulletin HYT-110.
DuPont Technical Bulletin HYT-166.
DuPont Technical Bulletin HYT-102 (R2).
DuPont Technical Bulletin HYT-158.
DuPont Technical Bulletin-Preliminary Data Sheet-Hytrel HTR-5735.
DuPont Technical Bulletin-Preliminary Data Sheet-Hytrel R-3548.

*Primary Examiner*—James J. Bell
*Attorney, Agent, or Firm*—Joseph P. Harps

[57] ABSTRACT

An elastomeric nonwoven web is formed by meltblowing fibers composed of a polyetherester. Nonelastic fibers and/or particulate materials may also be included in the web.

38 Claims, 3 Drawing Sheets

ELASTIC POLYETHERESTER NONWOVEN WEB

FIELD OF THE INVENTION

The present invention is generally directed to fiber formation and, in particular, to fibers which may be formed into nonwoven webs and the nonwoven webs formed therefrom.

BACKGROUND OF THE INVENTION

In the field of nonwoven materials, there has been a continuing need for materials having a high degree of flexibility and elasticity and which may be manufactured at a low cost. This need has persisted in spite of the fact that such materials could readily be utilized to manufacture a wide variety of garments of both the disposable type, such as disposable diapers, or the non-disposable type, such as pants, dresses, blouses and sporting wear, for example, sweatsuits. Further, such materials could also be utilized in, for example, upholstery, drapery, liner and insulation applications. The traits of flexibility and elasticity are particularly useful characteristics in materials for use in these areas because they permit articles manufactured from such materials to closely conform to the body of the wearer or any item, such as a fixed frame, around which the materials may be wrapped. Additionally, the need for an absorbent nonwoven elastic material has been recognized because such a material could be utilized to manufacture a great disparity of items which have improved absorbency performance as a result of the item's ability to closely conform to a body portion or to some other item which needs to be wrapped in an absorbent material. For example, such a material could be readily utilized in the areas of feminine hygiene or wound dressing.

While the above-discussed combination of characteristics has been a goal of those of skill in the field of nonwoven materials, the prior commercial materials known to us are believed to be lacking or insufficient in one or more of the above-discussed desired characteristics. For example, one group of materials which has been available to those in treating injuries are the so-called "elastic bandages", an example of which is an elastic bandage which is commercially available from the 3M Company of Minneapolis, Minn. under the trade designation "Ace Bandage". Elastic bandages of this type are generally effective in somewhat immobilizing an injured area. However, such elastic bandages generally have a poor ability to absorb bodily fluids exuding from the wound.

Another material for similar uses appears in U.K. Pat. No. 1,575,830 to Johnson and Johnson which relates to flexible and absorbent dressings including diapers, surgical dressings, first aid dressings, catamenial dressings and the like. This patent further appears to relate to dressings which include an absorbent layer laminated to a plastic backing film. The backing film is stated to be elastic and easily stretchable, as well as highly flexible. The elastic backing film may be formed from a blend of materials which contains (a) a major portion of linear or radial A-B-A block copolymers or mixtures of linear or radial A-B-A block copolymers with A-B block copolymers and (b) a resin component. It is stated that the A-blocks of the block copolymers may be derived from styrene or styrene homologs and that the B-blocks may be derived from conjugated dienes or lower alkenes and the resin component may typically include a major portion of a lower molecular weight resin adapted to associate principally with the thermoplastic A-blocks of the block copolymers. It should be noted that this patent deals with an elastic film as opposed to an elastic nonwoven web.

U.S. Pat. No. 4,426,417 to Meitner appears to disclose a matrix of nonwoven fibers which can be used as a wiper with the matrix including a meltblown web having a blend of staple fibers which is a mixture of synthetic and cotton fibers blended therein. The wipers may be formed by a meltblowing process by extruding thermoplastic polymers as filaments into an air stream which draws and attenuates the filaments into fine fibers of an average diameter of up to about ten microns. The staple fiber mixture of synthetic and cotton fibers may be added to the air stream so that the turbulence produced by the air stream results in a uniform integration of the staple fiber mixture into the meltblown web. The meltblown fiber component of the matrix may be formed from any thermoplastic composition capable of extrusion into microfibers. It is stated that examples of such compositions include polyolefins, such as polypropylene and polyethylene, polyesters, such as polyethylene terephthalate, polyamides, such as nylon, as well as copolymers and blends of these and other thermoplastic polymers. The synthetic staple fiber component of the matrix may be selected from the same thermoplastic materials with polyester being preferred. The cotton component includes staple length cotton fibers of average length generally in the range of from about one quarter inch to three quarter inch and denier from about one to one and one half. It is stated that the process for making the material includes compacting the matrix on a forming drum and then directing it over a feed roll and between a patterned roll and an anvil roll where it is pattern bonded. The particular bond pattern is preferably selected to impart favorable textile-like tactile properties while providing strength and durability.

U.S. Pat. No. 4,426,420 to Likhyani appears to disclose a spunlaced fabric which may be made by the hydraulic entanglement of hard fibers (i.e., fibers generally having low stretch characteristics) and potentially elastomeric fibers (fibers capable of elongation by at least one hundred percent before breaking and which are capable of exhibiting elastic characteristics after having been subjected to heat treatment). After hydraulic entanglement of the two types of fibers, the fabric is heat treated to develop the elastic characteristics in the elastomeric fibers. It is stated that the hard fibers may be of any synthetic fiber-forming material, such as polyesters, polyamides, acrylic polymers and copolymers, vinyl polymers, cellulose derivatives, glass, and the like, as well as any natural fiber such as cotton, wool, silk, paper and the like, or a blend of two or more hard fibers. A representative class of potentially elastic fibers is stated to include polyetheresters and more specifically, poly(butylene terephthalate)-co-poly(tetramethyleneoxy) terephthalates.

U.S. Pat. No. 4,100,324 to Anderson et al appears to disclose a nonwoven fabric-like material including an air-formed matrix of thermoplastic polymer microfibers and a multiplicity of individualized wood pulp fibers or staple fibers such as high crimped nylon fibers. It is stated that many useful thermoplastic polymers, polyolefins such as polypropylene and polyethylene, polyamides, polyesters such as polyethylene terephthalate, and thermoplastic elastomers such as polyurethanes are anticipated to find the most widespread use in the preparation of the materials of the U.S. Pat. No. 4,100,324.

U.S. Pat. No. 3,700,545 to Matsui appears to disclose a synthetic multi-segmented fiber which includes at least ten segments composed of at least one component of fiber-forming linear polyamide and polyester extending substantially continuously along the longitudinal direction of the fiber and occupying at least a part of the periphery of the unitary multi-segmented fiber. These fibers may be produced by spinning a multi-segment spinning material having a cross-section of grainy, nebulous or archipelagic structure.

U.S. Pat. No. 3,594,266 to Okazaki appears to disclose melt spinning of a sheath/core bicomponent fiber where one component is a polyamide and the other component is a block-copolyether amide. Okazaki also discusses meltspinning of a sheath/core bicomponent fiber having a first component of a blend of polyamide and a copolyetheramide and a second component of Nylon 6. It is stated that the latter material has 34 percent elongation.

DEFINITIONS

The term "elastic" is used herein to mean any material which, upon application of a biasing force, is stretchable to a stretched, biased length which is at least about 125 percent, that is at least about one and one quarter, of its relaxed, unbiased length, and which will recover at least about 40 percent of its stretch or elongation upon release of the stretching, elongating force. A hypothetical example which would satisfy this definition of an elastic or elastomeric material would be a one (1) inch sample of a material which is elongatable to at least 1.25 inches and which, upon being elongated to 1.25 inches and released, will return to a length of not more than 1.15 inches. Many elastic materials may be stretched by much more than 25 percent of their relaxed length, for example 100 percent, or more, and many of these will return to substantially their original relaxed length, for example, to within 105 percent of their original relaxed length upon release of the stretching, elongating force.

As used herein the term "nonelastic" is intended to include any material not encompassed by the above definition of the term "elastic".

As used herein the term "microfibers" means small diameter fibers having an average diameter not greater than about 100 microns, preferably having a diameter of from about 0.5 microns to about 50 microns, more preferably having an average diameter of from about 4 microns to about 40 microns.

As used herein the term "meltblown fibers" means fibers formed by extruding a molten thermoplastic material through a plurality of fine, usually circular, die capillaries as molten threads or filaments into a high velocity gas (e.g. air) stream which attenuates the filaments of molten thermoplastic material to reduce their diameter. Thereafter, the meltblown fibers are carried by the high velocity gas stream and are deposited on a collecting surface to form a web of randomly disbursed meltblown microfibers. Such a process is disclosed, for example, in U.S. Pat. No. 3,848,241 to Butin and the disclosure of this patent is hereby incorporated by reference.

As used herein the term "nonwoven" includes any web of material which has been formed without the use of a weaving process which produces a structure of individual fibers which are interwoven in an identifiable repeating manner. Specific examples of nonwoven webs would include, without limitation, a meltblown nonwoven web, a spunbonded nonwoven web and a carded web. Nonwoven webs generally have an average basis weight of from about 5 grams per square meter to about 300 grams per square meter. More particularly, nonwoven webs may have an average basis weight of from about 10 grams per square meter to about 100 grams per square meter.

As used herein the term "polyetherester" refers to any material having the general formula of:

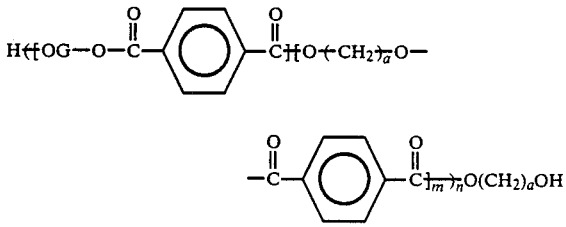

where

"G" is selected from the group including poly(oxyethylene)-alpha,omega-diol poly(oxypropylene)-alpha,omega-diol or poly(oxytetramethylene)-alpha,omega-diol and "m", "n" and "a" are positive integers. For example, "a" may be 2, 4 or 6.

As used herein the term "absorbent material" means any material which is capable of absorbing or retaining at least 100 percent of its weight of a fluid.

As used herein the term "absorbent fiber" means any fiber which is capable of absorbing at least 100 percent of its weight of a fluid.

As used herein the term "superabsorbent fiber" means any fiber which is capable of absorbing at least 400 percent of its weight of a fluid.

Unless herein specifically set forth and defined or otherwise limited, the term polymer generally includes, but is not limited to, homopolymers, copolymers, such as, for example, block, graft, random and alternating copolymers, terpolymers, etc. and blends and modifications thereof. Furthermore, unless otherwise specifically limited, the term polymer shall include all possible geometrical configurations of the material. These configurations include, but are not limited to, isotactic, syndiotactic and random symmetries and, for example, linear and radial polymers.

As used herein the term "consisting essentially of" does not exclude the presence of additional materials which do not significantly affect the properties of a given material. Exemplary additional materials of this sort would include, without limitation, pigments, antioxidants, stabilizers, waxes, flow promoters, solvents, plasticizers, particulates and materials added to enhance the processability of the material.

OBJECTS OF THE INVENTION

Accordingly, it is a general object of the present invention to provide elastic fibers formed from a polyetherester.

Another general object of the present invention is to provide an elastic nonwoven web which is composed of a coherent nonwoven matrix of elastic fibers formed from a polyetherester.

Yet another general object of the present invention is to provide an elastic nonwoven web which is composed of a coherent nonwoven matrix of elastic fibers formed from a polyetherester with at least one other type of fiber being distributed within or on the matrix.

A further object of the present invention is to provide an elastic absorbent nonwoven web which is composed of a coherent nonwoven matrix of elastic fibers formed from a polyetherester with at least one type of absorbent fiber being distributed within or on the matrix.

Still further objects and the broad scope of applicability of the present invention will become apparent to those of skill in the art from the details given hereinafter. However, it should be understood that the detailed description of the presently preferred embodiment given herein of the present invention is given only by way of illustration because various changes and modifications well within the spirit and scope of the invention will become apparent to those of skill in the art in view of this detailed description.

SUMMARY OF THE INVENTION

The present invention provides elastic meltblown fibers formed from a polyetherester polymer. The elastic meltblown fibers may be formed into an elastic nonwoven web which includes a coherent nonwoven matrix of fibers which, for example, may be microfibers. The elastic nonwoven web may also include at least one type of secondary fibers, for example secondary microfibers, which are distributed within or upon the matrix. The secondary fibers may be generally uniformly distributed throughout the matrix.

The elastic fibers are formed from a polyetherester material having the formula:

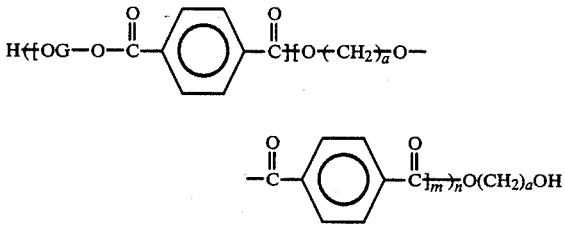

where

"G" is selected from the group including: poly(oxyethylene)-alpha,omega-diol poly(oxypropylene)-alpha,omega-diol poly(oxytetramethylene)-alpha,omega-diol and "a", "m" and "n" are positive integers. For example, "a" may be 2, 4 or 6.

The polyetherester may have a melt flow rate of from about 4.0 to about 7.0 grams per 10 minutes when measured in accordance with ASTM D-1238 at 190 degrees C. under a 2,160 gram load; a melting point of from about 275 degrees F. to about 425 degrees F. when measured in accordance with ASTM D-3418 (differential scanning calorimeter—peak of endotherm); a specific gravity of from about 1.10 to 1.20 when measured in accordance with ASTM D-792; a tensile stress at break (head speed 2 inches per minute) of from about 2,000 psi to about 4,250 psi when measured in accordance with ASTM D-638; an elongation at break of from about 200 percent to about 600 percent when measured in accordance with ASTM D-638 and a flexural modulus at 212 degrees F. of from about 3,500 psi to about 10,000 psi.

One particular polyetherester has a melt flow rate of about 5.3 grams per 10 minutes when measured in accordance with ASTM D-1238 at 190 degrees C. and under a 2,160 gram load; a melting point of about 298 degrees F. when measured in accordance with ASTM D-3418 (differential scanning calorimeter—peak of endotherm); a specific gravity of about 1.16 when measured in accordance with ASTM D-792; a tensile stress at break (head speed 2 inches per minute) of about 4,050 psi when measured in accordance with ASTM D-638; an elongation at break of about 550 percent when measured in accordance with ASTM D-638 and a flexural modulus at 212 degrees F. of about 3,900 psi.

The secondary fibers, which may be microfibers, may be selected from the group including polyester fibers, polyamide fibers, glass fibers, polyolefin fibers, cellulosic derived fibers, multi-component fibers, natural fibers or electrically conductive fibers or blends of two or more of said secondary fibers. If the secondary fibers are natural fibers, the natural fibers may be selected from the group including cotton fibers, wool fibers and silk fibers. If the secondary fibers are polyolefin fibers, the polyolefin fibers may be selected from the group including polyethylene fibers or polypropylene fibers. If the secondary fibers are cellulosic derived fibers, the cellulosic derived fibers may be selected from the group including rayon fibers or wood fibers, for example, wood pulp. If the secondary fibers are polyamide fibers, the polyamide fibers may be nylon fibers. If the secondary fibers are multi-component fibers, the multi-component fibers may be sheath-core fibers or side-by-side fibers. The secondary fibers may be absorbent or superabsorbent fibers.

If the secondary fibers which are present in the nonwoven elastic web have an average length of greater than 0.25 inch, the nonwoven elastic web may generally include from about 60 percent, by weight, to about 99 percent, by weight, of fibers formed from the polyetherester material blended with from about 1 percent, by weight to 40 percent, by weight, of the secondary fibers. For example, the elastic nonwoven web may include from about 80 percent, by weight to about 99 percent, by weight, of fibers formed from the polyetherester blended with from about 1 percent, by weight, to about 20 percent, by weight, of the secondary fibers. More particularly, the elastic nonwoven web may include from about 90 percent, by weight, to about 95 percent, by weight, of fibers formed from the polyetherester blended with from about 5 percent, by weight, to about 10 percent, by weight, of the secondary fibers.

If the secondary fibers which are present in the elastic nonwoven web have an average length of 0.25 inch or less, the elastic web may generally include from about 20 percent, by weight, by about 99 percent, by weight, of the fibers formed from the polyetherester material blended with about 1 percent, by weight, to about 80 percent, by weight of the secondary fibers. For example, the elastic nonwoven web may include from about 50 percent, by weight, to about 99 percent, by weight, of the fibers formed from the poletherester material blended with from about 1 percent, by weight, to about 50 percent, by weight, of the secondary fibers. More particularly, the elastic nonwoven web may include from about 90 percent, by weight, to about 95 percent, by weight, of fibers formed from the poletherester material blended with from about 5 percent, by weight, to about 10 percent, by weight, of the secondary fibers.

In certain applications particulate materials may be substituted for the secondary fibers. If particulate materials are present in the elastic nonwoven web the particulate materials may be incorporated into the web in the amounts stated for secondary fibers of an average length less than 0.25 inch. Alternatively, the elastic nonwoven web may have both secondary fibers and particulate materials incorporated into the matrix of coherent polyetherester fibers. In such a three component system, the elastic nonwoven web may contain from about 20 percent, by weight, to about 98 percent, by weight, of the polyetherester fibers, from about 1 percent, by weight, to about 79 percent, by weight, of secondary fibers and from about 1 percent, by weight, to about 79 percent, by weight, of particulate materials. Exemplary particulate materials are activated charcoal and powdered superabsorbent.

Prior to its utilization in forming meltblown fibers, the polyetherester may be treated to have a moisture content of at least 0.1 percent, by weight. For example, the polyetherester may be treated to have a moisture content of at least 0.2 percent, by weight.

DETAILED DESCRIPTION OF THE INVENTION

Figure 1:
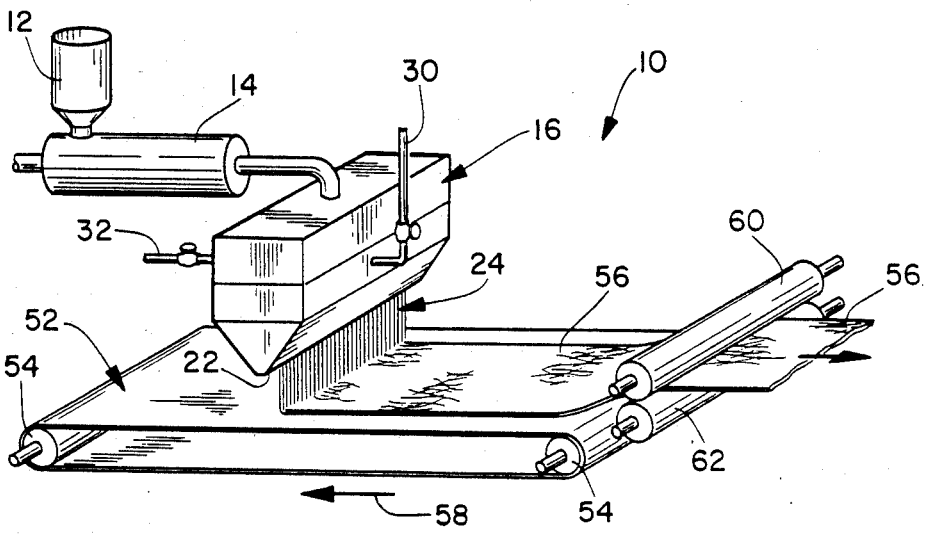
FIG. 1 is a schematic illustration of an apparatus which may be utilized to form the elastic nonwoven web of the present invention.

Turning now to the figures wherein like reference numerals represent the same or equivalent structure and, in particular, to FIG. 1 where it can be seen that an apparatus for forming the elastic nonwoven web of the present invention is schematically generally represented by reference numeral 10. In forming the elastic nonwoven web of the present invention pellets or chips, etc. (not shown) of a polyetherester material are introduced into a pellet hopper 12 of an extruder 14.

One polyetherester may be obtained under the trade designation Hytrel from the DuPont Company of Wilmington, Del. DuPont literature indicates that at least four grades of Hytrel are are available under the trade designations 4056, G-4074, G-4766 and G-4774. This literature also reports certain properties of these materials which are summarized below in Table I.

TABLE I

| | Physical Properties of Hytrel (Injection Molded Pieces) | | | | |
|---|---|---|---|---|---|
| PROPERTY | 4056 | G-4074 | G-4766 | G-4774 | ASTM TEST |
| Melt Flow Rate (g/10 min) | 5.3 (4.1–6.5)**** | 5.2 | 11–15*** | 12*** | D-1238 190° C., 2,160 gram load |
| Melting Point (°F.)* | 298 | 343 | 410 | 406 | D-3418 |

TABLE I-continued

| | Physical Properties of Hytrel (Injection Molded Pieces) | | | | |
|---|---|---|---|---|---|
| PROPERTY | 4056 | G-4074 | G-4766 | G-4774 | ASTM TEST |
| Tensile Strength at Break (psi)** | 4,050 | 2,000 | 3,050 | 2,975 | D-638 |
| Elongation at Break (%)** | 550 | 170 | 500 | 275 | D-638 |
| Flexural Modulus at 212° F. (psi) | 3,900 | 4,760 | — | 10,000 | D-790 |
| Specific Gravity | 1.16 | 1.18 | 1.16 | 1.2 | D-792 |

*Differential Scanning Calorimeter, peak of endotherm
**Head speed 2 inches/minute
***At 230° C., 2,160 gram load
****Non-Du Pont literature From the table, above, it can be seen that these Hytrel polyetherester materials have a melt flow rate of from about 4.0 to about 7.0 grams per 10 minutes when measured in accordance with ASTM D-1238 at 190 degrees C. under a 2,160 gram load; a melting point of from about 275 degrees F. to about 425 degrees F. when measured in accordance with ASTM D-3418 (differential scanning calorimeter—peak of endotherm); a specific gravity of from about 1.10 to 1.20 when measured in accordance with ASTM D-792; a tensile stress at break (head speed 2 inches per minute) of from about 2,000 psi to about 4,250 psi when measured in accordance with ASTM D-638; an elongation at break of from about 200 percent to about 600 percent when measured in accordance with ASTM D-638 and a flexural modulus at 212 degrees F. of from about 3,500 psi to about 10,000 psi.

More particularly, the Hytrel 4056 polyetherester has melt flow rate of about 5.3 grams per 10 minutes when measured in accordance with ASTM D-1238 at 190 degrees C. and under a 2,160 gram load; a melting point of about 298 degrees F. when measured in accordance with ASTM D-3418 (differential scanning calorimeter—peak of endotherm); a specific gravity of about 1.16 when measured in accordance with ASTM D-792; a tensile stress at break (head speed 2 inches per minute) of about 4,050 psi when measured in accordance with ASTM D-638; an elongation at break of about 550 percent when measured in accordance with ASTM D-638 and a flexural modulus at 212 degrees F. of about 3,900 psi.

One step that has been found to be helpful is to treat the polyetherester material prior to extrusion so that it has a moisture content of at least 0.1 percent, by weight. For example, the moisture content of the polyetherester material may be maintained at greater than 0.2 percent, by weight. This procedure, as is evidenced by the data in Examples 17–22, aids in increasing the throughput rate of the polyetherester material through the die 16. This naturally increases productivity.

The polyetherester may be mixed with other appropriate materials, such as, for example, pigments, antioxidants, plasticizers, stabilizers, waxes, flow promoters, solvents, particulates and processing enhancing additives, prior to or after its introduction into the hopper 12.

The extruder 14 has an extrusion screw (not shown) which is driven by a conventional drive motor (not shown). As the polyetherester advances through the extruder 14, due to rotation of the extrusion screw by the drive motor, it is progressively heated to a molten state. Heating of the polyetherester to the molten state may be accomplished in a plurality of discrete steps with its temperature being gradually elevated as it advances through discrete heating zones of the extruder 14 toward a meltblowing die 16. The die 16 may be yet another heating zone where the temperature of the thermoplastic resin is maintained at an elevated level for extrusion. The temperature which will be required to heat the polyetherester to a molten state will vary somewhat depending upon which grade of polyetherester is utilized and can be readily determined by those in the art. However, generally speaking, the Hytrel polyetherester may be extruded within the temperature range of from about 185 degrees Centigrade to about 330 degrees Centigrade. For example, the extrusion may be accomplished within a temperature range of from about 200 degrees Centigrade to about 320 degrees Centigrade. Heating of the various zones of the extruder 14 and the meltblowing die 16 may be achieved by any of a variety of conventional heating arrangements (not shown).

Figure 2:
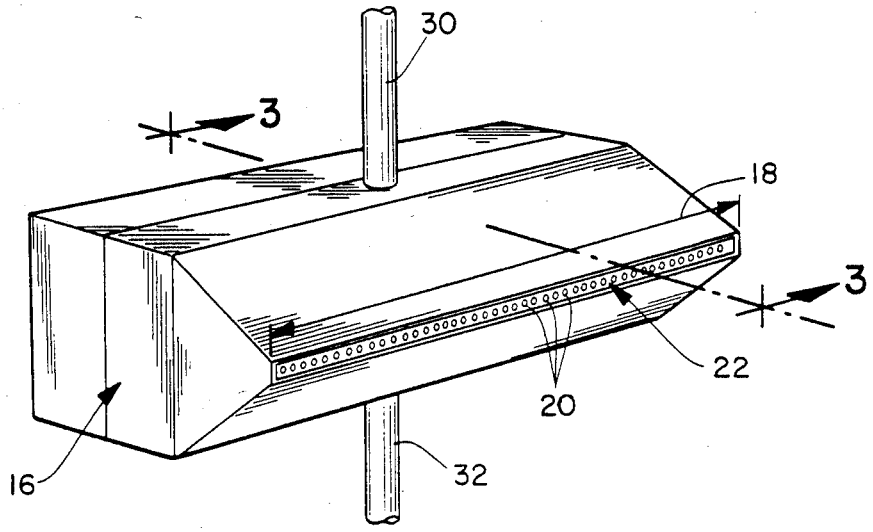
FIG. 2 is a bottom view of the die of FIG. 1 with the die having been rotated 90 degrees for clarity.

FIG. 2 illustrates that the lateral extent 18 of the die 16 is provided with a plurality of orifices 20 which are usually circular in cross-section and are linearly arranged along the extent 18 of the tip 22 of the die 16. The orifices 20 of the die 16 may have diameters that range from about 0.01 of an inch to about 0.02 of an inch and a length which may range from about 0.05 inches to about 0.20 inches. For example, the orifices may have a diameter of about 0.0145 inches and a length of about 0.113 inches. From about 5 to about 50 orifices may be provided per inch of the lateral extent 18 of the tip 22 of the die 16 with the die 16 extending from about 20 inches to about 60 inches or more. FIG. 1 illustrates that the molten polyetherester emerges from the orifices 20 of the die 16 as molten strands or threads 24.

Figure 3:
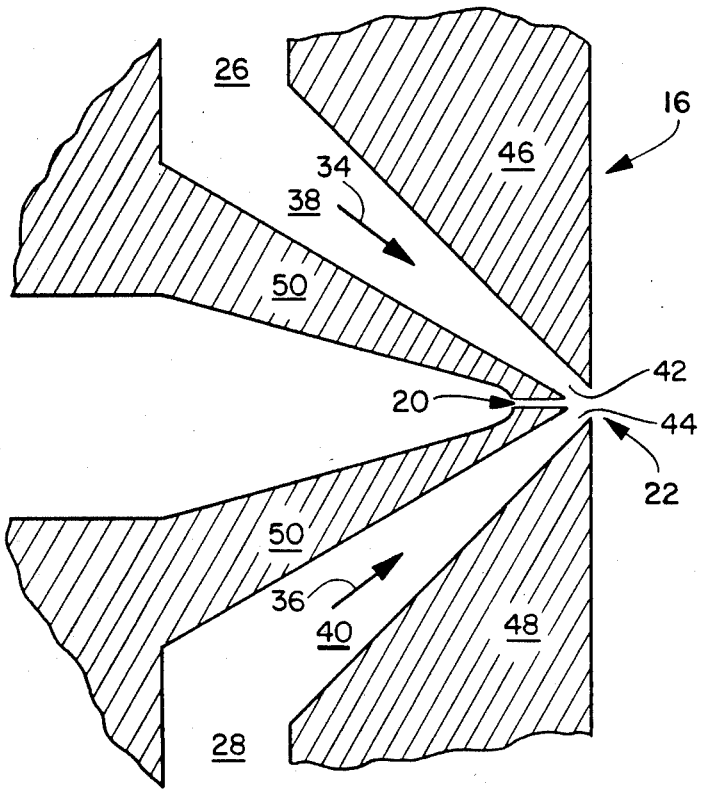
FIG. 3 is a cross-sectional view of the die of FIG. 1 taken along line 3—3 of FIG. 2.

FIG. 3, which is a cross-sectional view of the die of FIG. 2 taken along line 3—3, illustrates that the die 16 preferably includes attenuating gas inlets 26 and 28 which are provided with heated, pressurized attenuating gas (not shown) by attenuating gas sources 30 and 32. (See FIGS. 1 and 2.) The heated, pressurized attenuating gas enters the die 16 at the inlets 26 and 28 and follows a path generally designated by the arrows 34 and 36 through the two chambers 38 and 40 and on through the two narrow passageways or gaps 42 and 44 so as to contact the extruded threads 24 as they exit the orifices 20 of the die 16. The chambers 38 and 40 are designed so that the heated attenuating gas passes through the chambers 38 and 40 and exits the gaps 42 and 44 to form a stream (not shown) of attenuating gas which exits the die 16 on both sides of the threads 24. The temperature and pressure of the heated stream of attenuating gas can vary widely. For example, the heated attenuating gas can be applied at a temperature of from about 80 degrees Centigrade to about 370 degrees Centigrade, more particularly, from about 200 degrees Centigrade to about 330 degrees Centigrade. The heated attenuating gas may generally be applied at a pressure of from about 0.2 pounds per square inch, gage to about 20 pounds per square inch, gage. More particularly, from about 0.5 pounds per square inch, gage to about 10 pounds per square inch, gage.

The position of air plates 46 and 48 which, in conjunction with a die portion 50 define the chambers 38 and 40 and the gaps 42 and 44, may be adjusted relative to the die portion 50 to increase or decrease the width of the attenuating gas passageways 42 and 44 so that the volume of attenuating gas passing through the air passageways 42 and 44 during a given time period can be varied without varying the velocity of the attenuating gas. Furthermore, the air plates 46 and 48 may be adjusted to effect a "recessed". die-tip configuration as illustrated in FIG. 3. Generally speaking, a recessed die-tip configuration and attenuating gas pressures of less than 8 pounds per square inch, gage are used in conjunction with air passageway widths, which are usually the same and are no greater in width than about 0.20 inches. Lower attenuating gas velocities and wider air passageway gaps are generally preferred if substantially continuous meltblown fibers or microfibers 24 are to be produced.

The two streams of attenuating gas converge to form a stream of gas which entrains and attenuates the molten threads 24, as they exit the orifices 20, into fibers or, depending upon the degree of attenuation, microfibers, of a small diameter which is less than the diameter of the orifices 20. The gas-borne fibers or microfibers 24 are blown, by the action of the attenuating gas, onto a collecting arrangement which, in the embodiment illustrated in FIG. 1, is a foraminous endless belt 52 conventionally driven by rollers 54. Other foraminous arrangements such as a rotating drum could be utilized. One or more vacuum boxes (not illustrated) may be located below the surface of the foraminous belt 52 and between the rollers 54. The fibers or microfibers 24 are collected as a matrix 56 of entangled fibers on the surface of the endless belt 52 which is rotating as indicated by the arrow 58 in FIG. 1. Depending upon process conditions, the fibers may adhere to each other upon their contacting each other when the matrix is formed on the endless belt 52. Generally speaking, as the distance between the die tip 22 and the belt 52 increases, the adhesiveness of the fibers 24 decreases due to the fact that the fibers have had a greater amount of time to cool and solidify prior to contacting each other. The vacuum boxes assist in retention of the matrix 56 on the surface of the belt 52. Typically the tip 22 of the die 16 is from about 4 inches to about 24 inches from the surface of the foraminous belt 52 upon which the fibers are collected. The thus-collected, matrix 56 of entangled fibers or microfibers 24 and may be removed from the belt 52 as a self-supporting coherent nonwoven web 56 by a pair of pinch rollers 60 and 62 which may be designed to press the fibers of the web 56 together to improve the integrity of the web 56.

Figure 4:
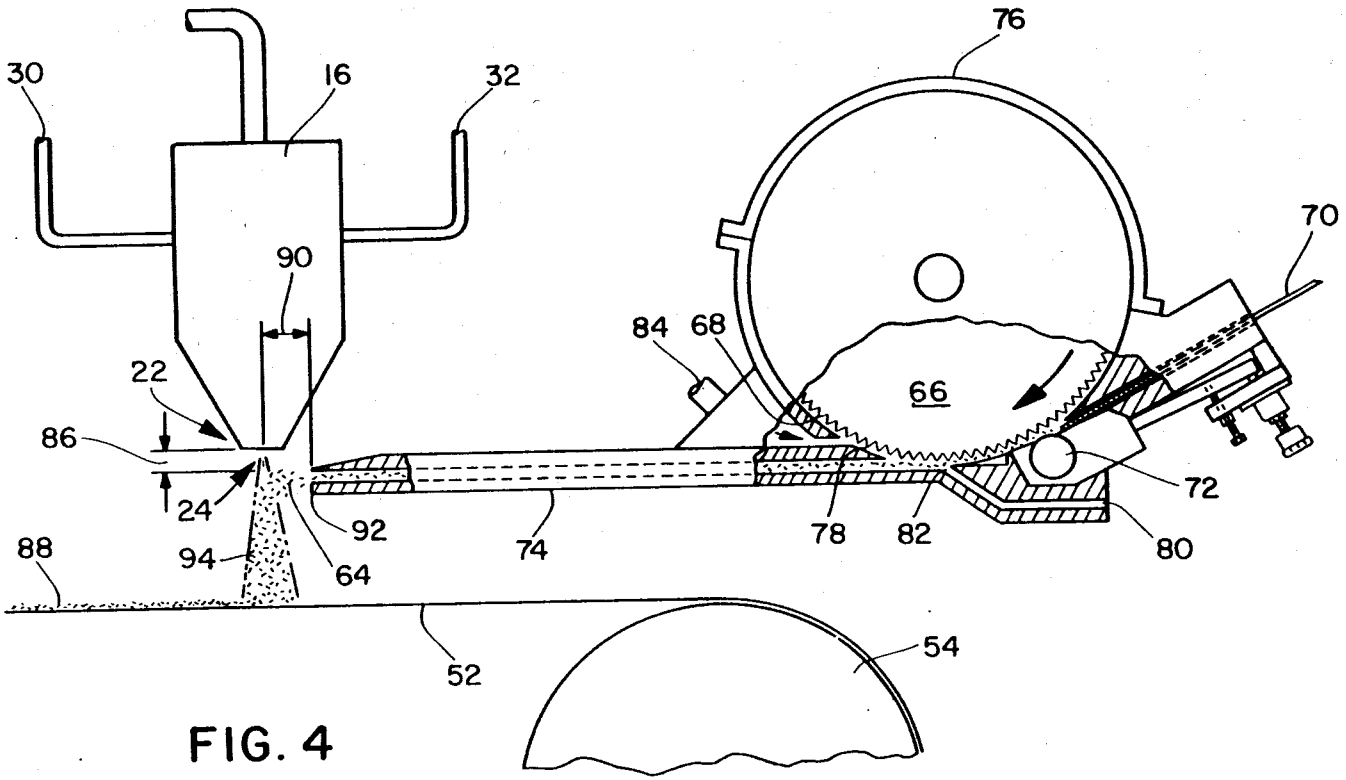
FIG. 4 is a schematic illustration of an apparatus which may be utilized to form the embodiment of the present invention where secondary fibers are incorporated into the matrix of coherent polyetherester fibers.

FIG. 4 illustrates another embodiment of the present invention where one or more type of secondary fibers 64 are distributed within or upon the stream of thermoplastic fibers or microfibers 24. Distribution of the secondary fibers 64 within the stream of fibers 24 may be such that the secondary fibers 64 are generally uniformly distributed throughout the stream of polyetherester fibers 24. This may be accomplished by merging a secondary gas stream (not shown) containing the secondary fibers 64 with the stream of fibers 24. Apparatus for accomplishing this merger may include a conventional picker roll 66 arrangement which has a plurality of teeth 68 that are adapted to separate a mat, sheet or batt 70 of secondary fibers into the individual secondary fibers 64. The mat, sheet or batt of secondary fibers 70 which is fed to the picker roll 66 may be of pulp fibers (if a two component mixture of polyetherester fibers and secondary pulp fibers is desired), of staple fibers (if a two component mixture of polyetherester fibers and secondary staple fibers is desired) or of both pulp fibers and staple fibers (if a three component mixture of polyetherester fibers, secondary staple fibers and secondary pulp fibers is desired). In embodiments where, for example, absorbent or superabsorbent characteristics are desired, the secondary fibers 64 are absorbent or superabsorbent fibers. The secondary fibers 64 may generally be selected from the group including one or more polyester fibers, polyamide fibers, polyolefin fibers such as, for example, polyethylene fibers and polypropylene fibers, cellulosic derived fibers such as, for example, rayon fibers and wood pulp fibers, multi-component fibers such as, for example, sheath-core multi-component fibers or side-by-side multi-component fibers, natural fibers such as silk fibers, wool fibers or cotton fibers, electrically conductive fibers, absorbent fibers, superabsorbent fibers or blends of two or more of such secondary fibers. Other types of secondary fibers 64 as well as blends of two or more of other types of secondary fibers 64 may be utilized. The secondary fibers 64 may be microfibers or the secondary fibers 64 may be macrofibers having an average diameter of from about 300 microns to about 1,000 microns.

The sheets, batts or mats 70 of secondary fibers 64 are fed to the picker roll 66 by a roller arrangement 72. After the teeth 68 of the picker roll 66 have separated the mat, sheet or batt of secondary fibers 70 into separate secondary fibers 64 the individual secondary fibers 64 are conveyed toward the stream of polyetherester fibers or microfibers 24 through a nozzle 74. A housing 76 encloses the picker roll 66 and provides a passageway or gap 78 between the housing 76 and the surface of the teeth 68 of the picker roll 66. A gas (not shown), for example air, is supplied to the passageway or gap 78 between the surface of the picker roll 66 and the housing 76 by way of a gas duct 80. The gas duct 80 may enter the passageway or gap 78 generally at the junction 82 of the nozzle 74 and the gap 78. The gas is supplied in sufficient quantity to serve as a medium for conveying the secondary fibers 64 through the nozzle 74. The gas supplied from the duct 80 also serves as an aid in removing the secondary fibers from the teeth 68 of the picker roll 66. However, gas supplied through the duct 84 generally provides for removal of the secondary fibers 64 from the teeth 68 of the picker roll 66. The gas may be supplied by any conventional arrangement such as, for example, an air blower (not shown).

Generally speaking, the individual secondary fibers 64 are conveyed through the nozzle 74 at about the velocity at which the secondary fibers 64 leave the teeth 68 of the picker roll 66. In other words, the secondary fibers 64, upon leaving the teeth 68 of the picker roll 66 and entering the nozzle 74, generally maintain their velocity in both magnitude and direction from the point where they left the teeth 68 of the picker roll 66. Such an arrangement, which is discussed in more detail in U.S. Pat. No. 4,100,324 to Anderson et al., hereby incorporated by reference, aids in substantially reducing fiber floccing.

As an aid in maintaining satisfactory secondary fiber 64 velocity, the nozzle 74 may be positioned so that its longitudinal axis is substantially parallel to a plane which is tangent to the picker roll 6 at the junction 82 of the nozzle 74 with the passageway 78. As a result of this configuration, the velocity of the secondary fibers 64 is not substantially changed because of contact of the secondary fibers 64 with the walls of the nozzle 74. If the secondary fibers 64 temporarily remain in contact with the teeth 68 of the picker roll 66 after they have been separated from the mat or batt 70, the axis of the nozzle 74 may be adjusted appropriately to be aligned with the direction of secondary fiber 64 velocity at the point where the secondary fibers 64 disengage from the teeth 68 of the picker roll 66. The disengagement of the secondary fibers 64 from the teeth 68 of the picker roll 66 may be assisted by application of a pressurized gas, i.e., air through duct 84.

The vertical distance 86 that the nozzle 74 is below the die tip 22 may be adjusted to vary the properties of the composite web 88. Variation of the horizontal distance 90 of the tip 92 of the nozzle 74 from the die tip 22 will also achieve variations in the final elastic nonwoven web 88. The vertical distance 86 and the horizontal distance 90 values will also vary with the material being added to the polyetherester fibers 24. The width of the nozzle 74 along the picker roll 66 and the length that the nozzle 74 extends from the picker roll 66 are also important in obtaining optimum distribution of the secondary fibers 64 throughout the stream of fibers 24. It is usually desirable for the length of the nozzle 74 to be as short as equipment design will allow. The length is usually limited to a minimum length which is generally equal to the radius of the picker roll 66. Usually, the width of the nozzle 74 should not exceed the width of the sheets, batts or mats 70 that are being fed to the picker roll 66.

The picker roll 66 may be replaced by a conventional particulate injection system to form a composite nonwoven web 88 containing various secondary particulates. A combination of both secndary particulates and secondary fibers could be added to the polyetherester fibers prior to formation of the composite nonwoven web 88 if a conventional particulate injection system was added to the left side of the system illustrated in FIG. 4.

FIG. 4 further illustrates that the gas stream carrying the secondary fibers 64 is moving in a direction which is generally perpendicular to the direction of movement of the stream of polyetherester fibers 24 at the point of merger of the two streams. Other angles of merger of the two streams may be utilized. The velocity of the gas stream of secondary fibers 64 is usually adjusted so that it is less than the velocity of the stream of polyetherester fibers 24. This allows the streams, upon merger and integration thereof to flow in substantially the same direction as that of the stream of polyetherester fibers 24. Indeed, the merger of the two streams may be accomplished in a manner which is somewhat like an aspirating effect where the stream of secondary fibers 64 is drawn into the stream of polyetherester fibers 24. If desired, the velocity difference between the two gas streams may be such that the secondary fibers 64 are integrated into the polyetherester fibers 24 in a turbulent manner so that the secondary fibers 64 become substantially thoroughly and uniformly mixed throughout the polyetherester fibers 24. Generally, for increased production rates, the gas stream which entrains and attenuates the stream of polyetherester fibers 24 should have a comparatively high initial velocity, for example from about 200 feet to over 1,000 feet per second, and the stream of gas which carries the secondary fibers 64 should have a comparatively low initial velocity, for example from about 50 to about 200 feet per second. After the stream of gas that entrains and attenuates the polyetherester fibers 24 exits the gaps 42 and 44 of the die 16, it immediately expands and decreases in velocity.

Upon merger and integration of the stream of secondary fibers 64 into the stream of polyetherester fibers 24 to generally uniformly distribute the secondary fibers 64 throughout the stream of polyetherester fibers 24, a composite stream 94 of polyetherester fibers 24 and secondary fibers 64 is formed. If the polyetherester fibers 24 are still semi-molten and tacky at the time of incorporation of the secondary fibers 64 into the polyetherester fibers 24, the secondary fibers 64 are not only mechanically entangled within the coherent matrix formed by the polyetherester fibers 24 but may also be thermally bonded or joined to the polyetherester fibers 24.

In order to convert the composite stream 94 of polyetherester fibers 24 and secondary fibers 64 into a composite elastic nonwoven web or mat 88 composed of a coherent matrix of the polyetherester fibers 24 having the secondary fibers 64 generally uniformly distributed therein, a collecting device is located in the path of the composite stream 94. The collecting device may be the endless belt 52 of FIG. 1. The belt 52 is usually porous and a conventional vacuum arrangement (not shown) which assists in retaining the composite stream 94 on the external surface of the belt 52 is usually present. Other collecting devices are well known to those of skill in the art and may be utilized in place of the endless belt 52. For example, a porous rotating drum arrangement could be utilized. Thereafter, the composite elastic nonwoven web 88 is removed from the screen by the action of rollers such as roller 60 and 62 shown in FIG. 1.

If the secondary fibers 64 which are present in the nonwoven elastic web 88 have an average length of greater than 0.25 inch, the nonwoven elastic web 88 may generally include from about 60 percent, by weight, to about 99 percent, by weight, of fibers 24 formed from the polyetherester material blended with from about 1 percent, by weight to 40 percent, by weight, of the secondary fibers 64. For example, the elastic nonwoven web 88 may include from about 80 percent, by weight to about 99 percent, by weight, of fibers 24 formed from the polyetherester blended with from about 1 percent, by weight, to about 20 percent, by weight, of the secondary fibers 64. More particularly, the elastic nonwoven web 88 may include from about 90 percent, by weight, to about 95 percent, by weight, of fibers 24 formed from the polyetherester blended with from about 5 percent, by weight, to about 10 percent, by weight, of the secondary fibers 64.

If the secondary fibers 64 which are present in the elastic nonwoven web 88 have an average length of 0.25 inch or less, the elastic web 88 may generally include from about 20 percent, by weight, by about 99 percent, by weight, of the fibers 24 formed from the polyetherester material blended with about 1 percent, by weight, to about 80 percent, by weight of the secondary fibers 64. For example, the elastic nonwoven web 88 may include from about 50 percent, by weight, to about 99 percent, by weight, of the fibers 24 formed from the polyetherester material blended with from about 1 percent, by weight, to about 50 percent, by weight, of the secondary fibers 64. More particularly, the elastic nonwoven web 88 may include from about 90 percent, by weight, to about 95 percent, by weight, of fibers 24 formed from the polyetherester material blended with from about 5 percent, by weight, to about 10 percent, by weight, of the secondary fibers 64.

In certain applications, particulate materials may be substituted for the secondary fibers 64. If the particulate materials are present in the nonwoven elastic web 88, the particulates may be incorporated into the elastic web in the amounts stated for secondary fibers 64 having an average length of less than 0.25 inch. The reason that fewer long (greater than 0.25 inch) secondary fibers 64 can be incorporated into the elastic web 88 is that if more than 40 percent, by weight, of long (greater than 0.25 inch) fibers are added the elastic properties of the web 88 are progressively degraded. However, with secondary fibers of shorter length (0.25 inch or less) up to about 80 percent, by weight, of such secondary fibers can be added without significantly degrading the elastic properties of the web 88. In this regard particulates tend to affect the elastic characteristics of the nonwoven web 88 in a manner generally the same as the short secondary fibers 64.

Alternatively, the elastic nonwoven web 88 may have both secondary fibers 64 and particulate materials incorporated into the coherent matrix of polyetherester fibers. In such a three component system, the elastic nonwoven web 88 may contain from about 20 percent, by weight, to about 98 percent, by weight, of the polyetherester fibers 24, from about 1 percent, by weight, to about 79 percent, by weight, of secondary fibers 64 and from about 1 percent, by weight, to about 79 percent, by weight, of particulate materials. However, care must be taken in the blending to assure that the elastic properties of the nonwoven web 88 are not degraded to an unsatisfactory degree. Exemplary particulate materials are activated charcoal and powdered superabsorbent materials.

Examples 1–9 demonstrate the formation of an elastic nonwoven web from a polyetherester (Hytrel 4056) at three different air pressures and three different polymer temperatures.

EXAMPLE 1

A fibrous nonwoven elastic web was formed by meltblowing a polyetherester obtained from the DuPont Company Inc. under the trade designation Hytrel 4056 which had been preconditioned at 50 percent relative humidity at room temperature.

Meltblowing of the fibrous nonwoven elastic web was accomplished by extruding the thermoplastic elastomer through a 1½ inch diameter Johnson extruder and through a meltblowing die having 30 extrusion capillaries per lineal inch of die tip. Quench air of about 20 cubic feet per minute per inch of machine width was blown on the fibers about three inches below the die tip to help cool the fibers. The capillaries each had a diameter of about 0.0145 inches and a length of about 0.113 inches. The polymer was extruded through the capillaries at a rate of about 0.175 grams per capillary per minute at a temperature of about 293 degrees Centigrade. The extrusion pressure exerted upon the polymer in the die tip was measured as 112 pounds per square inch, gage. The die tip configuration was adjusted so that it had a 0.010 die tip stickout from the plane of the external surface of the lips of the air plates which form the air passageways on either side of the capillaries. The air plates were adjusted so that the two air passageways, one on each side of the extrusion capillaries, formed air passageways of a width or gap of about 0.070 inches. Forming air for meltblowing the polymer was supplied to the air passageways at a temperature of about 315 degrees Centigrade and at a pressure of about 2 pounds per square inch, gage. The viscosity of the polymer was calculated at 458 poise in the capillaries. The meltblown fibers thus formed were blown onto a forming screen which was approximately 16 inches from the die tip and which was moving at a speed of about 8 feet per minute.

Examples 2–9 were conducted in the fashion stated with regard to Example 1. All of the examples were performed with Hytrel 4056 which had been preconditioned at 50 percent relative humidity at room temperature on a 1½ inch diameter Johnson extruder and with a meltblowing die which had 30 extrusion capillaries per lineal inch of die tip. The capillaries of the meltblowing die each had a diameter of about 0.0145 inches and a length of about 0.113 inches. The various process parameters of Examples 2–9 are detailed in Table I.

TABLE I

| Example | 2 | 3 | 4 | 5 | 6 | 7 | 8 | 9 |
|---|---|---|---|---|---|---|---|---|
| Quench Air[1] | 20 | 20 | 20 | 20 | 20 | 20 | 20 | 20 |
| Extrusion Rate[2] | 0.175 | 0.175 | 0.175 | 0.175 | 0.175 | 0.175 | 0.175 | 0.175 |
| Extrusion Temperature[3] | 293 | 293 | 304 | 304 | 304 | 315 | 315 | 315 |
| Extrusion Pressure[4] | 116 | 122 | 84 | 80 | 79 | 49 | 48 | 44 |
| Die Tip Stick-Out[5] | 0.010 | 0.010 | 0.010 | 0.010 | 0.010 | 0.010 | 0.010 | 0.010 |
| Air Passageway Gap[6] | 0.070 | 0.070 | 0.070 | 0.070 | 0.070 | 0.070 | 0.070 | 0.070 |
| Air Temperature[7] | 315 | 315 | 315 | 315 | 315 | 315 | 315 | 315 |
| Air Pressure[8] | 4 | 6 | 6 | 4 | 2 | 2 | 4 | 6 |
| Material Viscosity[9] | 474 | 498 | 343 | 327 | 322 | 200 | 196 | 178 |
| Distance[10] Die-Tip to Forming Screen | 16 | 16 | 16 | 16 | 16 | 20 | 16 | 16 |
| Forming Screen[11] Speed | 8 | 8 | 8 | 8 | 8 | 8 | 8 | 8 |

[1]in cubic feet per minute per inch of machine width
[2]in grams per capillary per minute
[3]in degrees Centigrade
[4]in pounds per square inch, gage in the capillaries
[5]negative values indicate recessed die tip arrangement, in inches
[6]in inches
[7]in degrees Centigrade
[8]in pounds per square inch, gage
[9]in poise
[10]in inches
[11]in feet per minute The surface area, in square meters per gram of nonwoven web, of the fibers of the elastic nonwoven webs of Examples 1–9 was calculated by using a Quantasorb surface analyzer utilizing Krypton gas. Additionally, by using an Instron tester, the machine direction strip tensile, in grams, and the percent peak elongation (elongation to break) of the nine sample webs was calculated. The initial jaw separation of the Instron tester was 1 inch and the crosshead speed of the Instron tester was 5 inches per minute. The data obtained is detailed in Table II.

TABLE II[1]

| Sample # | Surface Area $M^2$/gram | Machine Direction Strip Tensile, grams | Peak Elongation % |
|---|---|---|---|
| 1 | 0.196 | 4995 | 810 |
| 2 | 0.225 | 3855 | 464 |
| 3 | 0.254 | 4056 | 93 |
| 4 | 0.297 | 4786 | 71 |
| 5 | 2.256 | 3427 | 145 |
| 6 | 0.211 | 3800 | 480 |
| 7 | 0.238 | 2602 | 200 |
| 8 | 0.302 | 3468 | 62 |

TABLE II[1]-*continued*

| Sample # | Surface Area $M^2$/gram | Machine Direction Strip Tensile, grams | Peak Elongation % |
|---|---|---|---|
| 9 | 0.277 | 4114 | 61 |

[1]All data reported in Table II are average values obtained from 5 replicate tests of two inch wide samples. Additionally, all data has been normalized to a nonwoven web having having a basis weight of 100 grams per square meter.

Utilizing the results of the elongation to break (peak elongation) data obtained from the tests reported in Table II, each of the nine samples was stretched in an Instron tester four times to 75 percent of its elongation to break. Each of the samples was then stretched to break. The data obtained for each of the samples is reported in Tables III through XI. In Tables III through XI the data is an average value of two replicate tests of two inch wide samples. The tensile and energy values have been normalized to a nonwoven web having a basis weight of 100 grams per square meter. The percent of permanent set was calculated by using the formula:

$$\text{Permanent Set, } \% = (l_f - l_o)/(l_s - l_o)$$

Where $l_o$=Original length of sample
$l_s$=Length sample stretched
$l_f$=Length of sample after stretching

TABLE III

| Example 1 - stretch cycled to 610% | | | | |
|---|---|---|---|---|
| Stretch No. | Strip Tensile, grams | Energy Absorbed During Stretch, Inch Pounds | Energy Recovered During Relaxation, Inch Pounds | Cumulative Permanent Set, % |
| 1 | 5098 | 44.8 | 4.33 | 49 |
| 2 | 4504 | 8.97 | 4.52 | 51 |
| 3 | 4208 | 7.74 | 4.40 | 52 |
| 4 | 4053 | 7.11 | 4.28 | 52 |
| 5 | 5413 | 10.5 | | |

TABLE III-continued

| Example 1 - stretch cycled to 610% | | | | |
|---|---|---|---|---|
| Stretch No. | Strip Tensile, grams | Energy Absorbed During Stretch, Inch Pounds | Energy Recovered During Relaxation, Inch Pounds | Cumulative Permanent Set, % |
| (Break) | | | | |

Elongation to break = 645%

TABLE IV

| Example 2 - stretch cycled to 350% | | | | |
|---|---|---|---|---|
| Stretch No. | Strip Tensile, grams | Energy Absorbed During Stretch, Inch Pounds | Energy Recovered During Relaxation, Inch Pounds | Cumulative Permanent Set, % |
| 1 | 3549 | 21.4 | 2.93 | 42 |
| 2 | 3310 | 5.24 | 2.95 | 44 |
| 3 | 3156 | 4.66 | 2.88 | 46 |
| 4 | 3056 | 4.39 | 2.71 | 46 |
| 5 | 3965 | 8.75 | | |
| (Break) | | | | |

Elongation to break = 404%

TABLE V

| Example 3 - stretch cycled to 70% | | | | |
|---|---|---|---|---|
| Stretch No. | Strip Tensile, grams | Energy Absorbed During Stretch, Inch Pounds | Energy Recovered During Relaxation, Inch Pounds | Cumulative Permanent Set, % |
| 1 | 3583 | 3.49 | 1.11 | 17 |
| 2 | 3041 | 1.37 | 0.96 | 20 |
| 3 | 2927 | 1.27 | 0.96 | 21 |
| 4 | 2881 | 1.23 | 0.94 | 21 |
| 5 | 3922 | 3.22 | | |
| (Break) | | | | |

Elongation to break = 95%

TABLE VI

| Example 4 - stretch cycled to 53% | | | | |
|---|---|---|---|---|
| Stretch No. | Strip Tensile, grams | Energy Absorbed During Stretch, Inch Pounds | Energy Recovered During Relaxation, Inch Pounds | Cumulative Permanent Set, % |
| 1 | 4308 | 3.01 | 0.97 | 17 |
| 2 | 3507 | 1.17 | 0.95 | 19 |
| 3 | 3348 | 1.10 | 0.86 | 21 |
| 4 | 3305 | 1.07 | 0.84 | 21 |
| 5 | 4695 | 2.66 | | |
| (Break) | | | | |

Elongation to break = 70%

TABLE VII

| Example 5 - stretch cycled to 110% | | | | |
|---|---|---|---|---|
| Stretch No. | Strip Tensile, grams | Energy Absorbed During Stretch, Inch Pounds | Energy Recovered During Relaxation, Inch Pounds | Cumulative Permanent Set, % |
| 1 | 3532 | 6.34 | 1.51 | 24 |
| 2 | 3140 | 2.20 | 1.43 | 25 |
| 3 | 3011 | 2.02 | 1.41 | 28 |
| 4 | 2922 | 1.94 | 1.37 | 29 |
| 5 | 3716 | 2.98 | | |
| (Break) | | | | |

Elongation to Break = 125%

TABLE VIII

| Example 6 - stretch cycled to 360% | | | | |
|---|---|---|---|---|
| Stretch No. | Strip Tensile, grams | Energy Absorbed During Stretch, Inch Pounds | Energy Recovered During Relaxation, Inch Pounds | Cumulative Permanent Set, % |
| 1 | 3381 | 21.6 | 2.83 | 44 |
| 2 | 3160 | 5.06 | 2.85 | 47 |
| 3 | 3035 | 4.50 | 2.80 | 48 |
| 4 | 2952 | 4.26 | 2.78 | 49 |
| 5 | 4008 | 16.6 | | |
| (Break) | | | | |

Elongation to break = 510%

TABLE IX

| Example 7 - stretch cycled to 150% | | | | |
|---|---|---|---|---|
| Stretch No. | Strip Tensile, grams | Energy Absorbed During Stretch, Inch Pounds | Energy Recovered During Relaxation, Inch Pounds | Cumulative Permanent Set, % |
| 1 | 2608 | 6.90 | 1.36 | 32 |
| 2 | 2483 | 2.19 | 1.38 | 35 |
| 3 | 2352 | 1.96 | 1.32 | 37 |
| 4 | 2289 | 1.85 | 1.30 | 37 |
| 5 | 2776 | 2.86 | | |
| (Break) | | | | |

Elongation to break = 169%

TABLE X

| Example 8 - stretch cycled to 46% | | | | |
|---|---|---|---|---|
| Stretch No. | Strip Tensile, grams | Energy Absorbed During Stretch, Inch Pounds | Energy Recovered During Relaxation, Inch Pounds | Cumulative Permanent Set, % |
| 1 | 3458 | 2.08 | 0.65 | 17 |
| 2 | 2844 | 0.86 | 0.58 | 20 |
| 3 | 2765 | 0.82 | 0.55 | 20 |
| 4 | 2622 | 0.78 | 0.52 | 20 |
| 5 | 3770 | 1.94 | | |
| (Break) | | | | |

Elongation to break = 62%

TABLE XI

| Example 9 - stretch cycled to 46% | | | | |
|---|---|---|---|---|
| Stretch No. | Strip Tensile, grams | Energy Absorbed During Stretch, Inch Pounds | Energy Recovered During Relaxation, Inch Pounds | Cumulative Permanent Set, % |
| 1 | 4169 | 2.54 | 1.11 | 15 |
| 2 | 3466 | 1.04 | 0.71 | 17 |
| 3 | 3304 | 0.98 | 0.82 | 20 |
| 4 | 3189 | 0.95 | 0.66 | 20 |
| 5 | 4591 | 2.73 | | |
| (Break) | | | | |

Elongation to break = 65%

Tables III through XI demonstrate that the samples of Examples 1 through 9 achieve substantially all of their permanent set upon the initial stretch cycle, thereafter only a very small additional amount of permanent set is achieved. The high elasticity of the examples is demonstrated when the energy absorbed to achieve a stretch cycle is about the same from cycle to cycle and also when the energy recovered upon retraction of the sample in the cycle is about the same as the energy necessary to stretch the sample in a given cycle. The data of Tables III through XI demonstrate the elastic properties of the nine samples, especially in any stretch cycles after the initial stretch cycle has been completed.

Examples 10 through 14 demonstrate the formation of elastic nonwoven webs from a variety of different polyetherester materials.

EXAMPLE 10

Meltblowing of the fibrous nonwoven elastic web was accomplished by extruding the Hytrel 4056 through a 0.75 inch diameter Brabender extruder and through a meltblowing die having 20 extrusion capillaries per lineal inch of die tip. The capillaries each had a diameter of about 0.0145 inches and a length of about 0.113 inches. The polymer was extruded through the capillaries at a rate of about 0.225 grams per capillary per minute at a temperature of about 283 degrees Centigrade. The extrusion pressure exerted upon the polymer in the die tip was measured as 260 pounds per square inch, gage. The die tip configuration was adjusted so that it extended about 0.010 inches (0.010 inch die tip stick-out) beyond the plane of the external surface of the lips of the air plates which form the forming air passageways on either side of the capillaries. The air plates were adjusted so that the two forming air passageways, one on each side of the extrusion capillaries, formed air passageways of a width or gap of about 0.060 inches. Forming air for meltblowing the polymer was supplied to the air passageways at a temperature of about 283 degrees Centigrade and at a pressure of about 1.5 pounds per square inch, gage. The viscosity of the polymer was calculated at 763 poise in the capillaries. The meltblown fibers thus formed were blown onto a forming screen which was approximately 10 inches from the die tip.

The meltflow rate of the resulting meltblown web was 24, measured using a 2,160 gram weight at 190 degrees Centigrade.

EXAMPLE 11

Meltblowing of the fibrous nonwoven elastic web was accomplished by extruding the Hytrel G-4766 through a 0.75 inch diameter Brabender extruder and through a meltblowing die having 20 extrusion capillaries per lineal inch of die tip. The capillaries each had a diameter of about 0.0145 inches and a length of about 0.113 inches. The polymer was extruded through the capillaries at a rate of about 0.212 grams per capillary per minute at a temperature of about 283 degrees Centigrade. The extrusion pressure exerted upon the polymer in the die tip was measured as 278 pounds per square inch, gage. The die tip configuration was adjusted so that it extended about 0.010 inches (0.010 inch die tip stick-out) beyond the plane of the external surface of the lips of the air plates which form the forming air passageways on either side of the capillaries. The air plates were adjusted so that the two forming air passageways, one on each side of the extrusion capillaries, formed air passageways of a width or gap of about 0.060 inches. Forming air for meltblowing the polymer was supplied to the air passageways at a temperature of about 283 degrees Centigrade and at a pressure of about 1.5 pounds per square inch, gage. The viscosity of the polymer was calculated at 864 poise in the capillaries. The meltblown fibers thus formed were blown onto a forming screen which was approximately 10 inches from the die tip.

The meltflow rate of the resulting meltblown web was 72, measured using a 2,160 gram weight at 230 degrees Centigrade.

EXAMPLE 12

Meltblowing of the fibrous nonwoven elastic web was accomplished by extruding the Hytrel G-4074 through a 0.75 inch diameter Brabender extruder and through a meltblowing die having 20 extrusion capillaries per lineal inch of die tip. The capillaries each had a diameter of about 0.0145 inches and a length of about 0.113 inches. The polymer was extruded through the capillaries at a rate of about 0.225 grams per capillary per minute at a temperature of about 283 degrees Centigrade. The extrusion pressure exerted upon the polymer in the die tip was measured as 170 pounds per square inch, gage. The die tip configuration was adjusted so that it extended about 0.010 inches (0.010 inch die tip stick-out) beyond the plane of the external surface of the lips of the air plates which form the forming air passageways on either side of the capillaries. The air plates were adjusted so that the two forming air passageways, one on each side of the extrusion capillaries, formed air passageways of a width or gap of about 0.060 inches. Forming air for meltblowing the polymer was supplied to the air passageways at a temperature of about 283 degrees Centigrade and at a pressure of about 1.5 pounds per square inch, gage. The viscosity of the polymer was calculated at 499 poise in the capillaries. The meltblown fibers thus formed were blown onto a forming screen which was approximately 10 inches from the die tip.

The meltflow rate of the resulting meltblown web was 12, measured using a 2,160 gram weight at 190 degrees Centigrade.

EXAMPLE 13

Meltblowing of the fibrous nonwoven elastic web was accomplished by extruding the Hytrel 4774 through a 0.75 inch diameter Brabender extruder and through a meltblowing die having 20 extrusion capillaries per lineal inch of die tip. The capillaries each had a diameter of about 0.0145 inches and a length of about 0.113 inches. The polymer was extruded through the capillaries at a rate of about 0.225 grams per capillary per minute at a temperature of about 283 degrees Centigrade. The extrusion pressure exerted upon the polymer in the die tip was measured as 190 pounds per square inch, gage. The die tip configuration was adjusted so that it extended about 0.010 inches (0.010 inch die tip stick-out) beyond the plane of the external surface of the lips of the air plates which form the forming air passageways on either side of the capillaries. The air plates were adjusted so that the two forming air passageways, one on each side of the extrusion capillaries, formed air passageways of a width or gap of about 0.060 inches. Forming air for meltblowing the polymer was supplied to the air passageways at a temperature of about 283 degrees Centigrade and at a pressure of about 2.0 pounds per square inch, gage. The viscosity of the polymer was calculated at 558 poise in the capillaries. The meltblown fibers thus formed were blown onto a forming screen which was approximately 10 inches from the die tip.

The meltflow rate of the resulting meltblown web was 109, measured using a 2,160 gram weight at 230 degrees Centigrade.

EXAMPLE 14

Meltblowing of the fibrous nonwoven elastic web was accomplished by extruding the Hytrel 5526 through a 0.75 inch diameter Brabender extruder and through a meltblowing die having 20 extrusion capillaries per lineal inch of die tip. The capillaries each had a diameter of about 0.0145 inches and a length of about 0.113 inches. The polymer was extruded through the capillaries at a rate of about 0.231 grams per capillary per minute at a temperature of about 283 degrees Centigrade. The extrusion pressure exerted upon the polymer in the die tip was measured as 220 pounds per square inch, gage. The die tip configuration was adjusted so that it extended about 0.010 inches (0.010 inch die tip stick-out) beyond the plane of the external surface of the lips of the air plates which form the forming air passageways on either side of the capillaries. The air plates were adjusted so that the two forming air passageways, one on each side of the extrusion capillaries, formed air passageways of a width or gap of about 0.060 inches. Forming air for meltblowing the polymer was supplied to the air passageways at a temperature of about 283 degree Centigrade and at a pressure of about 2.0 pounds per square inch, gage. The viscosity of the polymer was calculated at 628 poise in the capillaries. The meltblown fibers thus formed were blown onto a forming screen which was approximately 10 inches from the die tip.

The meltflow rate of the resulting meltblown web was 98, measured using a 2,160 gram weight at 220 degrees Centigrade.

Machine direction strip tensile (in grams), machine direction energy to break (in inch pounds) and elongations to break data for the nonwoven webs of Examples 10, 11 and 13 were obtained by using an Instron testing machine and a two inch wide sample. While not actually measured, the initial jaw separation of the Instron tester is believed to have been one inch and the cross-head speed five inches per minute. The data is reported below in Table XII and is an average value obtained from four replicate tests with the value being normalized to a nonwoven web having a basis weight of 85 grams per square meter.

TABLE XII

| Sample | Machine Direction Strip Tensile, Grams | Machine Direction Energy to Break, Inch Pounds | Elongation % |
|---|---|---|---|
| 10 | 4366 | 33.1 | 460 |
| 11 | 4371 | 31.8 | 375 |
| 13 | 2006 | 3.14 | 56 |

Examples 15 and 16 were conducted to demonstrate that secondary fibers could be incorporated into the elastic nonwoven web of polyetherester fibers.

EXAMPLE 15

Meltblowing of the fibrous nonwoven elastic web was accomplished by extruding the Hytrel 4056 from a one and one-half inch Johnson extruder and through a meltblowing die having 15 extrusion capillaries per lineal inch of die tip. The capillaries each had a diameter of about 0.018 inches and a length of about 0.14 inches. The polymer was extruded through the capillaries at a rate of about 0.19 grams per capillary per minute at a temperature of about 313 degrees Centigrade. The extrusion pressure exerted upon the polymer in the die tip was measured as 203 pounds per square inch, gage, giving a viscosity for the polymer of about 764 poise in the die capillaries. The die tip configuration was adjusted so that it was recessed about 0.125 (−0.125 die tip stick-out) inches from the plane of the external surface of the lips of the air plates which form the attenuating air passgeways on either side of the row of capillaries. The air plates were adjusted so that the two attenuating air passages, one on each side of the extrusion capillaries, formed passageways having air gaps, i.e. widths, of about 0.067 inches. Forming air for meltblowing the polymer was supplied to the air passageways at a temperature of about 277 degrees Centigrade and at a pressure of about 2 pounds per square inch, gage. The meltblown fibers thus formed were blown toward a forming screen which was approximately 14 inches from the die tip. The forming screen was moving at about 13 feet per minute.

Utilizing the conventional coforming techniques as illustrated in FIG. 4, bleached cotton fibers obtained from Cotton Incorporated of N.Y. State and having a length of about one and one-half inches were incorporated into the stream of meltblown microfibers prior to their deposition upon the forming screen. The cotton fibers were first formed, by a Rando Webber mat forming apparatus, into a mat. The mat was fed to the picker roll by a picker roll feed roll which was positioned about 0.005 inches from the surface of the picker roll. The picker roll was rotating at a rate of about 3,000 revolutions per minute and fiber transporting air was supplied to the picker roll at a pressure of about 2 pounds per square inch, gage. Actual measurement of the position of the nozzle of the coform apparatus with respect to the stream of meltblown microfibers was not made. However, it is believed that the nozzle of the coforming apparatus was positioned about 2 inches below the die tip of the meltblowing die and about 2 inches back from the die tip of the meltblowing die. This procedure provided a fibrous nonwoven elastomeric web having a width (cross-machine direction) of about twenty (20) inches which was composed of a blend of about 70 percent, by weight, of the elastomeric meltblown microfibers and about 30 percent, by weight, of the cotton fibers.

A three inch wide by five inch long sample of the fibrous nonwoven web formed by the procedure of Example 15 was tested for elongation in both the machine direction and the cross-machine direction. The machine direction tests were conducted on a sample which was cut from the 20 inch wide web and measured three inches in the cross-machine direction and five inches in the machine direction. The cross-machine direction tests were conducted on a sample which was cut from the 20 inch wide web and measured three inches in the machine direction and five inches in the cross machine direction. Each sample was placed lengthwise in an Instron testing apparatus having an initial jaw setting of about three (3) inches and which stretched the samples at a rate thought to be about ten (10) inches per minute to a length which was 150 percent, that is one and one-half times, the length of the unstretched sample, i.e. 50 percent elongation. The load, in grams, necessary to achieve the 150 percent length was measured and the sample was maintained at the 150 percent length (50 percent elongation) for one (1) minute. At the end of the one minute period, the load, in grams, necessary to maintain the length of the sample at the 150 length (50 percent elongation) was measured and the length of the sample was increased from 150 percent to 200 percent of the original unstretched length of the sample, that is twice the original length of the unstretched sample, i.e. 100 percent elongation. The load, in grams, necessary to achieve the 200 percent length was measured and the sample was then maintained at the 200 percent length for a one minute. At the end of the second one minute period the load, in grams, necessary to maintain the length of the sample at 200 percent (100 percent elongation) was measured. Thereafter, all load was removed from the sample and the percent of permanent deformation of the sample was measured. (For hypothetical illustration only, if a three inch sample returned to 3.3 inches the percent of permanent deformation would be 10 percent, i.e., 0.3/3.0.) After measurement of the percent of permanent deformation, the sample was elongated to break (i.e., rupture) and the peak load, in grams, encountered during elongation of the sample to break and the percent of elongation of the sample at break was measured. The percent of elongation at break is reported as a percent of the unstretched length of the sample. For example, if a sample having an unstretched length of 3 inches broke at 9 inches its elongation at break value would be 200 percent.

The results are indicated in Table XIII where it can be seen that the load reduction after the one (1) minute waiting period decreased in each case and that the peak load was about that of the initial load at 100 percent elongation. These results demonstrate the elastomeric properties of the samples since to obtain a meaningful understanding of the elastomeric properties of material it is valuable to know both the percent of stretch to which the sample was subjected and the amount of permanent deformation which the material retained.

TABLE XIII*

| | Machine Direction | Cross-Machine Direction |
|---|---|---|
| Initial Load at the 150% length (50% elongation) | 1099 grams | 486 grams |
| Load at 150% length after 1 minute (50% elongation) | 753 grams | 350 grams |
| Initial Load at the 200% length (100% elongation) | 1253 grams | 726 grams |
| Load at the 200% length after 1 minute (100% elongation) | 849 grams | 504 grams |
| % Permanent Deformation | 38 | 35 |
| Peak Load Encountered | 1326 grams | 1099 grams |
| % Elongation at Break | 225 | 463 |

*Note that all results reported in Table XIII have been normalized to a nonwoven web having a basis weight of 85 grams per square meter.

EXAMPLE 16

Meltblowing of the fibrous nonwoven elastic web was accomplished by extruding the Hytrel 4056 from a one and one-half inch Johnson extruder and through a meltblowing die having 15 extrusion capillaries per lineal inch of die tip. The capillaries each had a diameter of about 0.018 inches and a length of about 0.14 inches. The polymer was extruded through the capillaries at a rate of about 0.19 grams per capillary per minute at a temperature of about 313 degrees Centigrade. The extrusion pressure exerted upon the polymer in the die tip was measured as 184 pounds per square inch, gage, giving a viscosity for the polymer of about 692 poise in the die capillaries. The die tip configuration was adjusted so that it was recessed about 0.125 (−0.125 die tip stick-out) inches from the plane of the external surface of the lips of the air plates which form the attenuating air passageways on either side of the row of capillaries. The air plates were adjusted so that the two attenuating air passages, one on each side of the extrusion capillaries, formed passageways having air gaps, i.e. widths, of about 0.067 inches. Forming air for meltblowing the polymer was supplied to the air passageways at a temperature of about 277 degrees Centigrade and at a pressure of about 6 pounds per square inch, gage. The meltblown fibers thus formed were blown toward a forming screen which was approximately 14 inches from the die tip. The forming screen was moving at about 13 feet per minute.

Utilizing the conventional coforming techniques as illustrated in FIG. 4, bleached cotton fibers obtained from Cotton Incorporated of N.Y. State and having a length of about one and one-half inches were incorporated into the stream of meltblown microfibers prior to their deposition upon the forming screen. The cotton fibers were first formed, by a Rando Webber mat forming apparatus, into a mat. The mat was fed to the picker roll by a picker roll feed roll which was positioned about 0.005 inches from the surface of the picker roll. The picker roll was rotating at a rate of about 3,000 revolutions per minute and fiber transporting air was supplied to the picker roll at a pressure of about 6 pounds per square inch, gage. Actual measurement of the position of the nozzle of the coform apparatus with respect to the stream of meltblown microfibers was not made. However, it is believed that the nozzle of the coforming apparatus was positioned about 2 inches below the die tip of the meltblowing die and about 2 inches back from the die tip of the meltblowing die. This procedure provided a fibrous nonwoven elastomeric web having a width (cross-machine direction) of about twenty (20) inches which was composed of a blend of about 70 percent, by weight, of the elastomeric meltblown microfibers and about 30 percent, by weight, of the cotton fibers.

A three inch wide by five inch long sample of the fibrous nonwoven web formed by the procedure of Example 16 was tested for elongation in both the machine direction and the cross-machine direction. The machine direction tests were conducted on a sample which was cut from the 20 inch wide web and measured three inches in the cross-machine direction and five inches in the machine direction. The cross-machine direction tests were conducted on a sample which was cut from the 20 inch wide web and measured three inches in the machine direction and five inches in the cross machine direction. Each sample was placed lengthwise in an Instron testing apparatus having an initial jaw setting of about three (3) inches and which stretched the samples at a rate thought to be about ten (10) inches per minute to a length which was 150 percent, that is one and one-half times, the length of the unstretched sample, i.e. 50 percent elongation. The load, in grams, necessary to achieve the 150 percent length was measured and the sample was maintained at the 150 percent length (50 percent elongation) for one (1) minute. At the end of the one minute period, the load, in grams, necessary to maintain the length of the sample at the 150 length (50 percent elongation) was measured and the length of the sample was increased from 150 percent to 200 percent of the original unstretched length of the sample, that is twice the original length of the unstretched sample, i.e. 100 percent elongation. The load, in grams, necessary to achieve the 200 percent length was measured and the sample was then maintained at the 200 percent length for a one minute. At the end of the second one minute period the load, in grams, necesssary to maintain the length of the sample at 200 percent (100 percent elongation) was measured. Thereafter, all load was removed from the sample and the percent of permanent deformation of the sample was measured. (For hypothetical illustration only, if a three inch sample returned to 3.3 inches the percent of permanent deformation would be 10 percent, i.e., 0.3/3.0.) After measurement of the percent of permanent deformation, the sample was elongated to break (i.e., rupture) and the peak load, in grams, encountered during elongation of the sample to break and the percent of elongation of the sample at break was measured. The percent of elongation at break is reported as a percent of the unstretched length of the sample. For example, if a sample having an unstretched length of 3 inches broke at 9 inches its elongation at break value would be 200 percent.

The results are indicated in Table XIV where it can be seen that the load reduction after the one (1) minute waiting period decreased in each case and that the peak load was about that of the initial load at 100 percent elongation. These results demonstrate the elastomeric properties of the samples since to obtain a meaningful understanding of the elastomeric properties of material it is valuable to know both the percent of stretch to which the sample was subjected and the amount of permanent deformation which the material retained.

TABLE XIV*

| | Machine Direction | Cross-Machine Direction |
|---|---|---|
| Initial Load at the 150% length (50% elongation) | 1493 grams | 1121 grams |
| Load at 150% length after 1 minute (50% elongation) | 917 grams | 690 grams |
| Initial Load at the 200% length (100% elongation) | 1897 grams | 1516 grams |
| Load at the 200% length after 1 minute (100% elongation) | 1148 grams | 922 grams |
| % Permanent Deformation | 41 | 42 |
| Peak Load Encountered | 1916 grams | 1553 grams |
| % Elongation at Break | 163 | 187 |

*Note that all results in Table XIV have been normalized to a nonwoven web having a basis weight of 85 grams per square meter.

Examples 17–22 were conducted to demonstrate the effect of the presence of moisture in the polyetherester polymer prior to its extrusion, and, in particular, to demonstrate its effect on the viscosity and melt index of the material.

EXAMPLE 17

A sample of Hytrel 4056 was taken from the bag as supplied by the vendor and immediately tested. The sample was found to contain 0.033 percent, by weight, of moisture. Evaluation of the polymer was accomplished by extruding the polymer from a one and one-half inch Johnson extruder and through a meltblowing die having 15 extrusion capillaries per lineal inch of die tip. The capillaries each had a diameter of about 0.018 inches and a length of about 0.14 inches. The polymer was extruded through the capillaries at a rate of about 0.30 grams per capillary per minute at a temperature of about 310 degrees Centrigrade. The extrusion pressure exerted upon the polymer in the die tip was measured at 165 pounds per square inch, gage, giving a viscosity for the polymer of about 786 poise in the die capillaries. The resulting extrudate was tested on a melt index unit at 190 degrees C. with a 2160 gram weight and found to have a melt index of 28.

EXAMPLE 18

A sample of Hytrel 4056 was taken from the vendor's bag and conditioned at 50 percent relative humidity for 18 hours. The sample was found to contain 0.193 percent, by weight, of moisture. Evaluation of the polymer was accomplished by extruding the polymer from a one and one-half inch Johnson extruder and through a meltblowing die having 15 extrusion capillaries per lineal inch of die tip. The capillaries each had a diameter of about 0.018 inches and a length of about 0.14 inches. The polymer was extruded through the capillaries at a rate of about 0.35 grams per capillary per minute at a temperature of about 310 degrees Centigrade. The extrusion pressure exerted upon the polymer in the die tip was measured as 88 pounds per square inch, gage, giving a viscosity for the polymer of about 360 poise in the die capillaries. The resulting extrudate was tested on a melt index unit at 190 degrees C. with a 2160 gram weight and found to have a melt index of 63.5.

EXAMPLE 19

A sample of Hytrel 4056 was taken from the bag as supplied by the vendor and dried in a Whitlock desiccant drier for 2 hours at 212 degrees F. The sample was found to contain 0.091 percent, by weight, of moisture. Evaluation of the polymer was accomplished by extruding the polymer from a one and one-half inch Johnson extruder and through a meltblowing die having 15 extrusion capillaries per lineal inch of die tip. The capillaries each had a diameter of about 0.018 inches and a length of about 0.14 inches. The polymer was extruded through the capillaries at a rate of about 0.35 grams per capillary per minute at a temperature of about 310 degrees Centigrade. The extrusion pressure exerted upon the polymer in the die tip was measured as 146 pounds per square inch, gage, giving a viscosity for the polymer of about 596 poise in the die capillaries. The resulting extrudate was tested on a melt index unit at 190 degrees C. with a 2160 gram weight and found to have a melt index of 35.

EXAMPLE 20

A sample of Hytrel 4056 was taken from the bag as supplied by the vendor and dried in a circulating oven at 200 degrees F. for 18 hours. The sample was found to have a moisture content of 0.033 percent, by weight. Evaluation of the polymer was accomplished by extruding the polymer from a one and one-half inch Johnson extruder and through a meltblowing die having 15 extrusion capillaries per lineal inch of die tip. The capillaries each had a diameter of about 0.018 inches and a length of about 0.14 inches. The polymer was extruded through the capillaries at a rate of about 0.35 grams per capillary per minute at a temperature of about 310 degrees Centigrade. The extrusion pressure exerted upon the polymer in the die tip was measured as 196 pounds per square inch, gage, giving a viscosity for the polymer of about 801 poise in the die capillaries. The resulting extrudate was tested on a melt index unit at 190 degrees C. with a 2160 gram weight and found to have a melt index of 25.5.

EXAMPLE 21

A sample of Hytrel 4056 was taken from the bag as supplied by the vendor and placed in an oven at 115 degrees F. with a dish of water present. The moisture content of the polymer was found to be 0.13 percent, by weight. Evaluation of the polymer was accomplished by extruding the polymer from a one and one-half inch Johnson extruder and through a meltblowing die having 15 extrusion capillaries per lineal inch of die tip. The capillaries each had a diameter of about 0.018 inches and a length of about 0.14 inches. The polymer was extruded through the capillaries at a rate of about 0.35 grams per capillary per minute at a temperature of about 310 degrees Centigrade. The extrusion pressure exerted upon the polymer in the die tip was measured as 114 pounds per square inch, gage, giving a viscosity for the polymer of about 466 poise in the die capillaries. The resulting extrudate was tested on a melt index unit at 190 degrees C. with a 2160 gram weight and found to have a melt index of 47.7.

EXAMPLE 22

A sample of Hytrel 4056 was taken from the bag as supplied by the vendor and conditioned for 18 hours at room temperature and 50 percent relative humidity as in Example 18. The sample was then dried in the Whitlock desiccant drier. The sample was found to contain 0.068 percent, by weight, of moisture. Evaluation of the polymer was accomplished by extruding the polymer from a one and one-half inch Johnson extruder and through a meltblowing die having 15 extrusion capillaries per lineal inch of die tip. The capillaries each had a diameter of about 0.018 inches and a length of about 0.14 inches. The polymer was extruded through the capillaries at a rate of about 0.35 grams per capillary per minute at a temperature of about 310 degrees Centrigrade. The extrusion pressure exerted upon the polymer in the die tip was measured as 108 pounds per square inch, gage, giving a viscosity for the polymer of about 441 poise in the die capillaries. The resulting extrudate was tested on a melt index unit at 190 degrees C. with a 2160 gram weight and found to have a melt index of 53.2.

The data of Examples 17 through 22 demonstrate a strong correlation between the percent of moisture present in a sample and the sample's viscosity. In particular, the higher the moisture content the lower the viscosity of the sample and the higher the melt index of the sample. Low viscosities and high melt index materials yield higher throughput rates. Accordingly, treating the sample prior to meltblowing to have a moisture content of at least about 0.1 percent will decrease the viscosity of Hytrel 4056 to about 600 poise. For example, treating the sample, prior to meltblowing, to have a moisture content of at least about 0.2 percent will decrease the viscosity of the Hytrel 4056 to about 350 poise.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. Elastic meltblown microfibers comprising:

a polyetherester material having the general formula of:

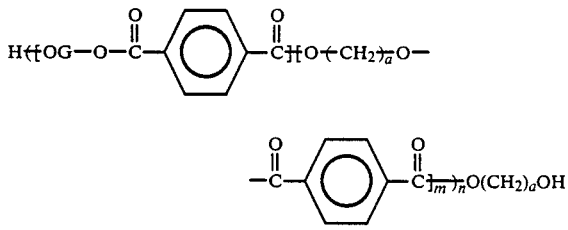

where:

"G" is selected from the group consisting of: poly(oxyethylene)-alpha,omega-diol poly(oxypropylene)-alpha,omega-diol poly(oxytetramethylene)-alpha,omega-diol and "a", "m" and "n" are positive integers.

2. The elastic meltblown fibers of claim 1, wherein "a" is selected from the group consisting of 2, 4 or 6.

3. The elastic meltblown fibers of claim 1, wherein said fibers are microfibers.

4. The elastic meltblown microfibers of claim 1, wherein said material has a melt flow of from about 4.0 to about 7.0 grams per 10 minutes when measured in accordance with ASTM D-1238 at 190° C. under a 2,160 gram load.

5. The elastic meltblown microfibers of claim 1, wherein said material has a melting point of from about 275° F. to about 425° F. when measured in accordance with ASTM D-3418.

6. The elastic meltblown microfibers of claim 1, wherein said material has an elongation at break of from about 200 percent to 600 percent when measured in accordance with ASTM D-638.

7. Elastic meltblown microfibers consisting essentially of:

a polyetherester material having the general formula of:

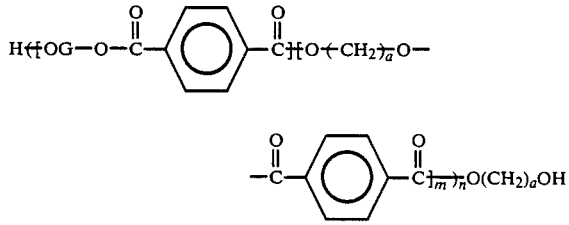

where:

"G" is selected from the group consisting of: poly(oxyethylene)-alpha,omega-diol poly(oxypropylene)-alpha,omega-diol poly(oxytetramethylene)-alpha,omega-diol and "a", "m" and "n" are positive integers.

8. An elastic nonwoven web comprising:

a coherent matrix of fibers formed from a polyethereseter material having the general formula of:

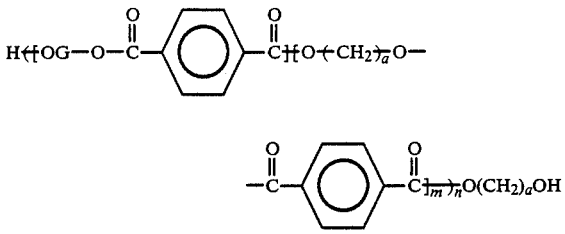

where:

"G" is selected from the group consisting of: poly(oxyethylene)-alpha,omega-diol poly(oxypropylene)-alpha,omega-diol poly(oxytetramethylene)-alpha,omega-diol and "a", "m" and "n" are positive integers.

9. The elastic nonwoven web of claim 8, wherein "a" is selected from the group consisting of 2, 4 or 6.

10. The elastic nonwoven web of claim 8, wherein said fibers are microfibers.

11. The elastic nonwoven web of claim 8, wherein said material has a melt flow of from about 4.0 to about 7.0 grams per 10 minutes when measured in accordance with ASTM D-1238 at 190° C. under a 2,160 gram load.

12. The elastic nonwoven web of claim 8, wherein said material has a melting point of from about 275° F. to about 425° F. when measured in accordance with ASTM D-3418.

13. The elastic nonwoven web of claim 8, wherein said material has an elongation at break of from about 200 percent to 500 percent when measured in accordance with ASTM D-638.

14. An elastic nonwoven web consisting essentially of:

a coherent matrix of fibers formed from a polyetherester material having the general formula of:

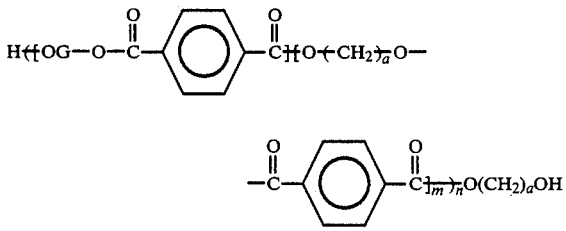

where:

"G" is selected from the group consisting of: poly(oxyethylene)-alpha,omega-diol poly(oxypropylene)-alpha,omega-diol poly(oxytetramethylene)-alpha,omega-diol and "a", "m" and "n" are positive integers.

15. An elastic nonwoven web comprising:

a coherent matrix of fibers formed from a polyetherester material having the general formula of:

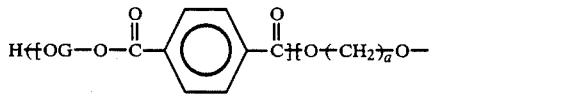

-continued

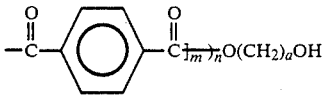

where:

"G" is selected from the group consising of: poly(oxyethylene)-alpha,omega-diol poly(oxypropylene)-alpha,omega-diol poly(oxytetramethylene)-alpha,omega-diol and "a", "m" and "n" are positive integers; and from about 1 percent, by weight, to about 40 percent, by weight, of nonelastic secondary fibers.

16. The elastic nonwoven web of claim 15, wherein "a" is selected from the group consisting of 2, 4 or 6.

17. The elastic nonwoven web of claim 15, wherein said fibers are microfibers.

18. The elastic nonwoven web of claim 15, wherein said material has a melt flow of from about 4.0 to about 7.0 grams per 10 minutes when measured in accordance with ASTM D-1238 at 190° C. under a 2,160 gram load.

19. The elastic nonwoven web of claim 15, wherein said material has a melting point of from about 275° F. to about 425° F. when measured in accordance with ASTM D-2117.

20. The elastic nonwoven web of claim 15, wherein said material has an elongation at break of from about 200 percent to 600 percent when measured in accordance with ASTM D-638.

21. The elastic nonwoven web of claim 15, wherein said secondary fibers have an average length of 0.25 inch or less.

22. The elastic nonwoven web of claim 15, wherein said secondary fibers have an average length of greater than 0.25 inch.

23. The elastic nonwoven web of claim 15 comprising from about 1 percent, by weight, to about 20 percent, by weight, of said secondary fibers.

24. The elastic nonwoven web of claim 15, wherein said secondary fibers are selected from the group consisting of polyester fibers, polyamide fibers, glass fibers, polyolefin fibers, cellulosic derived fibers, multi-component fibers, natural fibers, absorbent fibers, electrically conductive fibers or blends of two or more of said secondary fibers.

25. The elastic nonwoven web of claim 24, wherein said natural fibers are selected from the group consisting of cotton fibers, wool fibers or silk fibers.

26. The elastic nonwoven web of claim 24, wherein said polyolefin fibers are selected from the group consisting of polyethylene fibers or polypropylene fibers.

27. The elastic nonwoven web of claim 24, wherein said cellulosic derived fibers are selected from the group consisting of rayon fibers or wood fibers.

28. The elastic nonwoven web of claim 24, wherein said polyamide fibers are nylon fibers.

29. The elastic nonwoven web of claim 24, wherein said multi component fibers are selected from the group consisting of sheath-core or side-by-side fibers.

30. An elastic nonwoven web comprising:

a coherent matrix of fibers formed from a polyetherester material having the general formula of:

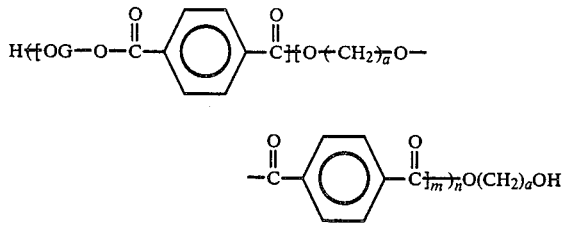

where:

"G" is selected from the group consisting of: poly-(oxyethylene)-alpha,omega-diol poly(oxy-propylene)-alpha,omega-diol poly(oxytetrame-thylene)-alpha,omega-diol and "a", "m" and "n" are positive integers; and from about 1 percent, by weight, to about 80 percent, by weight, of nonelastic secondary fibers having an average length of 0.25 inch or less.

31. The elastic nonwoven web of claim 30 comprising from about 1 percent, by weight, to about 80 percent, by weight, of said secondary fibers.

32. The elastic nonwoven web of claim 30 comprising from about 1 percent, by weight, to about 50 percent, by weight, of said secondary fibers.

33. The elastic nonwoven web of claim 30 comprising from about 1 percent, by weight, to about 40 percent, by weight, of said secondary fibers and from about 1 percent, by weight, to about 80 percent, by weight, of a particulate material.

34. An elastic nonwoven web consisting essentially of:

a coherent matrix of fibers formed from a polyetherester material having the general formula of:

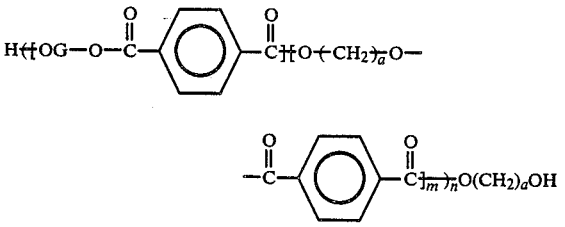

where:

G is selected from the group consisting of: poly(oxyethylene)-alpha,omega-diol poly(oxy-propylene)-alpha,omega-diol poly(oxytetrame-thylene)-alpha,omega-diol and a, m and n are positive integers; and from about 1 percent, by weight, to about 40 percent, by weight, of nonelastic secondary fibers.

35. An elastic nonwoven web comprising:

a coherent matrix of fibers formed from a polyetherester material having the general formula of:

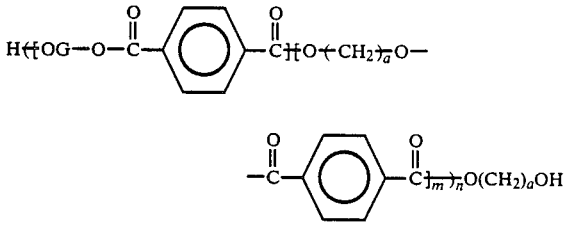

where:

"G" is selected from the group consisting of: poly-(oxyethylene)-alpha,omega-diol poly(oxy-propylene)-alpha,omega-diol poly(oxytetrame-thylene)-alpha,omega-diol and "a", "m" and "n" are positive integers; and from about 1 percent, by weight, to about 80 percent, by weight, of particulate materials.

36. A process for extruding a polyetherester material having the general formula of:

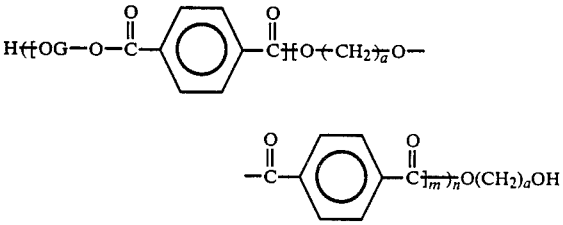

where:

"G" is selected from the group including: poly(oxyethylene)-alpha,omega-diol poly(oxypropylene)-alpha,omega-diol poly(oxytetramethylene)-alpha,omega-diol and "a", "m" and "n" are positive integers; and wherein said polyetherester material is treated prior to extrusion to achieve a moisture content of at least about 0.1 percent, by weight.

37. The process of claim 36, wherein the moisture content achieved is at least about 0.2 percent, by weight.

38. The process of claim 36, wherein the polyetherester material is meltblown to form a nonwoven web.

* * * * *

UNITED STATES PATENT AND TRADEMARK OFFICE
CERTIFICATE OF CORRECTION

PATENT NO. : 4,741,949

DATED : May 3, 1988

INVENTOR(S) : Michaël T. Morman, Tony J. Wisneski

It is certified that error appears in the above—identified patent and that said Letters Patent is hereby corrected as shown below:

Column 3, line 62, "3,848,241" should read --3,849,241--

Column 10, line 5, " "recessed". " should read --"recessed"--

Column 11, line 62, "picker roll 6" should read --picker roll 66--

Column 21, line 24, "degree" should read --degrees--

Column 26, line 6, "measured at" should read --measured as--

Signed and Sealed this

Twenty-fifth Day of October, 1988

*Attest:*

DONALD J. QUIGG

*Attesting Officer*

*Commissioner of Patents and Trademarks*